United States Patent [19]

Walsh

[11] Patent Number: 4,458,489

[45] Date of Patent: Jul. 10, 1984

[54] RESONANT FREE-PISTON STIRLING ENGINE HAVING VIRTUAL ROD DISPLACER AND LINEAR ELECTRODYNAMIC MACHINE CONTROL OF DISPLACER DRIVE/DAMPING

[75] Inventor: Michael M. Walsh, Schenectady, N.Y.

[73] Assignee: Mechanical Technology Incorporated, Latham, N.Y.

[21] Appl. No.: 402,302

[22] Filed: Jul. 27, 1982

[51] Int. Cl.[3] ..... F02G 1/06

[52] U.S. Cl. ..... 60/520; 60/518; 62/6

[58] Field of Search ..... 60/517, 518, 520, 525; 62/6

[56] References Cited

U.S. PATENT DOCUMENTS

| | | | |
|---|---|---|---|
| 3,937,018 | 2/1976 | Beale | 60/520 |
| 4,387,568 | 6/1983 | Dineen | 60/520 |
| 4,389,849 | 6/1983 | Gasser et al. | 62/6 |

*Primary Examiner*—William R. Cline
*Assistant Examiner*—Stephen F. Husar
*Attorney, Agent, or Firm*—Joseph V. Claeys; Arthur N. Trausch, III

[57] ABSTRACT

A new and improved resonant free-piston Stirling engine and method of operation employing a novel virtual rod displacer is described. A rod is secured to and reciprocally moves with the displacer within the Stirling engine and has a rod piston area formed on the end of the rod remote from the displacer with the rod piston area also being subjected to the working gas periodic pressure wave. Suitable support bearings are designed within the Stirling engine housing for reciprocatingly supporting the displacer and rod assembly within the Stirling engine with a set of opposed acting gas springs being provided to act on the displacer end and rod assembly area end of the displacer and rod assembly. One end of the displacer is designed to have a greater effective area acted upon by the gas contained within the engine than the effective area of the opposite end whereby the unbalanced areas of the opposing displacer ends create a differential force when acted upon by a periodic pressure wave, causing reciprocating motion of the displacer and virtual rod assembly. In the preferred embodiment a displacer electrodynamic machine is provided for selectively driving or loading the displacer and rod assembly to thereby control the stroke and/or phase angle at which the displacer and rod assembly move relative to the output power piston or work member.

32 Claims, 7 Drawing Figures

MOTORING AND/OR GENERATOR CONTROL
17
18
Pe
11
De
35
36
12
13
14A
14A
11S
11S
37
24
25
25
26
26
19
19
20
20
15
15
D1
D1
14
14
23
21
16
16
14B
14B
22
22
19
19
D2
Pc
12A
27
29
29
33
32
32
32
28
38
33
34
31
31
33
32
30
30
PG

Pe
17
18
11
De
35
12
13
36
14A
37
20
41
15
23
39
POSITIOINING MEANS
D1
21
14B
14C
19
22
D2
Pc
12A
27
31
33
32
29
28
34
38
3
30
PG

RESONANT FREE-PISTON STIRLING ENGINE HAVING VIRTUAL ROD DISPLACER AND LINEAR ELECTRODYNAMIC MACHINE CONTROL OF DISPLACER DRIVE/DAMPING

TECHNICAL FIELD

This invention relates to external combustion engines of the Stirling engine type. Resonant is operation at substantially the natural oscillation frequency of the engine system.

More particularly, the invention relates to a resonant free-piston Stirling engine having an improved virtual rod displacer and which preferably is used in conjunction with a displacer linear electrodynamic machine for controlling operation of the resonant free-piston Stirling engine. The displacer linear electrodynamic machine selectively can be operated either in the motor mode to drive the displacer or in the generator mode to load and thereby dampen the displacer and in this manner control over the operation of the resonant free-piston Stirling engine is achieved. The design of the virtual rod displacer makes it particularly well suited for use with a linear electrodynamic machine in controlling operation of a resonant free-piston Stirling engine.

BACKGROUND PRIOR ART

Resonant free-piston Stirling engines are known to the industry and have been described in a number of prior art patents, periodicals and textbooks, such as the textbook entitled "Stirling Engines" by G. Walker, published by Clarendon Press—Oxford, England—1980.

In free-piston Stirling engines (which may or may not operate resonantly) there are mechanical the thermodynamic requirements which work at cross purposes. This is particularly true if the displacer is partially powered by some means external to the Stirling engine cycle, such as the free-piston Stirling engine design described in U.S. Pat. No. 4,215,548-issued Aug. 5, 1980, for a "Free-Piston Regenerative Hot Gas Hydraulic Engine," for example.

In order to reciprocally support the displacer within the Stirling engine housing, a rod is required which must be large enough to provide mechanical stiffness sufficient to prevent the displacer forces from flexing the rod excessively, and which employs reasonable size bearings for the displacer and rod assembly.

Opposing the above-noted requirement, is the need for an unbalanced area on the displacer/rod drive assembly which is acted upon by the engine pressure wave, and the further requirement that the unbalanced area not be too large or the displacer will overstroke, making free oscillation difficult to achieve.

A further complication arises in the known free-piston Stirling engine designs due to the practice of using the displacer rod diameter to establish the size of the piston of the displacer gas spring which in combination with the displacer mass forms a spring-mass system with a natural frequency, substantially the same as the engine operating frequency. In such designs, the small rod area complicates the displacer gas spring design since extremely high pressure ratios (and high losses) must be accepted to achieve required stiffness for the displacer spring.

In order to overcome the above-noted difficulties in known free-piston Stirling engine designs, the present invention was devised.

SUMMARY OF INVENTION

It is therefore a primary purpose of the present invention to provide a new and improved virtual rod displacer assembly for a resonant free-piston Stirling engine.

Another object of the invention is to provide a new and improved resonant free-piston Stirling engine having a virtual rod displacer assembly and which is particularly well suited for use in conjunction with a displacer linear electrodynamic machine for controlling operation of the resonant free-piston Stirling engine.

A still further object of the invention is to provide a novel method of operating a resonant free-piston Stirling engine which employs a virtual rod displacer with or without a displacer linear electrodynamic machine for control purposes.

In practicing the invention a new and improved virtual rod displacer is provided for a resonant free-piston Stirling engine having a reciprocal movable displacer that is exposed to a working gas pressure wave periodically produced within the Stirling engine to drive a working member from which work is derived from the engine. The resonant free-piston Stirling engine normally includes a vessel for heating a charge of working gas enclosed within a working space formed in the Stirling engine housing and including the interior of the vessel. The working gas is heated by the vessel at one end of the working space and cooled by a cooler at the other end. The gas is shuttled back and forth from the heated end to the cooled end of the working space via a regenerator and cooler by the displacer which reciprocates axially within the Stirling engine housing to generate the periodic pressure wave in the working gas. The novel virtual rod displacer comprises a rod secured to and reciprocatingly movable with the displacer within the Stirling engine. A piston area is formed on the end of the rod remote from the displacer and is also subjected to the working gas periodic pressure wave. Bearing means secured to the Stirling engine housing reciprocatingly support the displacer and rod assembly within the Stirling engine and in conjunction with the rod define a set of opposed-acting gas springs acting on the displacer and rod assembly with the gas springs being of a stiffness chosen to make the displacer and rod assembly a spring-mass system having a natural frequency substantially the same as the desired operating frequency for the Stirling engine.

In a preferred embodiment of the invention, one end of the displacer has a greater effective area acted upon by the gas contained within the engine than the effective area acted upon by the gas on the opposite end of the displacer whereby unbalanced areas of the opposite ends of the displacer create a differential force acting upon the reciprocatingly movable displacer and rod assembly as a result of changes in engine pressure.

The preferred embodiment of the invention further includes gas porting means formed as part of the displacer rod and selectively communicating the opposing gas spring cavities and the interior of the displacer for equalizing pressure in the opposed-acting gas spring cavities and the interior of the displacer as the displacer and rod assembly passes substantially through the mid-stroke position during reciprocal movement thereof.

The preferred embodiment of the invention additionally includes a displacer linear electrodynamic machine having an armature secured to and movable with the displacer and rod assembly and having a stator supported by the Stirling engine housing in juxtaposition to the armature together with means for electrically exciting the displacer linear electrodynamic machine with electrical excitation signals having substantially the same frequency as the resonant frequency of operation of the Stirling engine. The displacer linear electrodynamic machine is designed as a general purpose machine capable of operation either as a linear electric motor or as a linear electric generator and further includes selectively operable electric control means for selectively and controllably causing the electrodynamic machine to function either as a generator load to extract power from the displacer and rod assembly whereby the displacer is caused to move with greater phase angle relative to the power piston or other working member of the Stirling engine and/or reduced stroke by which the engine operation is dampened, or, alternatively, selectively causing the displacer electrodynamic machine to operate as an electric drive motor to apply additional input power to the displacer and rod assembly whereby the displacer is caused to move with a larger stroke and/or a smaller phase angle relative to the power piston or other working member of the Stirling engine and increased power output can be derived from the engine.

BRIEF DESCRIPTION OF THE DRAWINGS

These and other objects, features and many of the attendant advantages of this invention will become better understood upon a detailed reading of the following description considered in conjunction with the accompanying drawings. In the drawings, like parts in each of the several figures are identified by the same reference character, and wherein.

BEST MODE OF PRACTICING INVENTION

Figure 1:
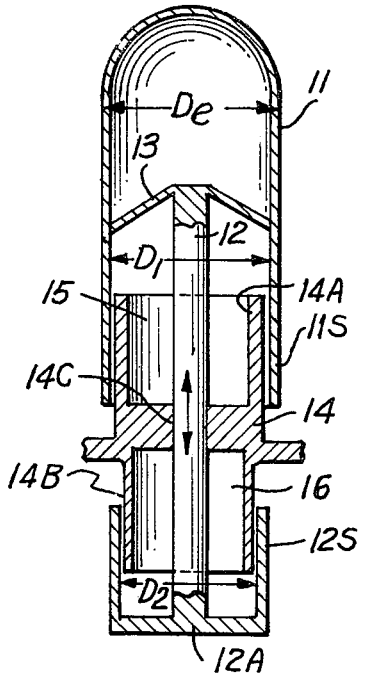
FIG. 1 is a schematic, longitudinal sectional view of one embodiment of a novel virtual rod displacer assembly constructed according to the invention.

In the embodiment of the invention shown in FIG. 1, a displacer is illustrated at 11 which is secured to and reciprocates in an up-down path of movement with a rod 12. The upper end of rod 12 is fixed to the inside of displacer 11 by means of an integral web portion 13 which may or may not have openings therethrough so that the space within displacer 11 above web portion 13 communicates with the space within the displacer 11 below the space portion. Alternatively, the web portion 13 may be an impermeable member so that the two spaces within the displacer are hermetically isolated. The rod 12 is journalled within a bearing support 14 which may comprise an integral part of the housing of a Stirling engine in which the displacer 11 is reciprocally mounted as will be explained more fully hereafter with respect to FIGS. 4 and 5 of the drawings. The bearing member 14 includes an upper cup-shaped portion 14A which extends upwardly into and fits within a lower skirt portion 11S of displacer 11. The exterior side surfaces of the upper cup-shaped bearing portion 14A are designed to slidably support the interior surfaces of the skirt portion 11S of the displacer and to form a close fitting seal therewith while still allowing up-down reciprocal movement of the displacer skirt portion 11S relative to the cup-shaped bearing surfaces 14A. Bearing member 14 further includes a downwardly depending cup-shaped bearing portion 14B having a diameter greater than the diameter of the rod 12 and having its open cup-shaped end opening downwardly. The lower end of rod 12 remote from the displacer 11 has an enlarged diameter piston area 12A formed thereon which includes an upwardly extending cup-shaped skirt portion 12S. The open end of the cup-shaped skirt portion 12S of the piston area end of rod 12 rides over and slidably engages the exterior surface of the downwardly depending cup-shaped portion 14B of bearing 14 so that the two mating surfaces form a close fitting seal therebetween but allow relative reciprocal motion to occur.

By reason of the above described construction, the space within the interior of the upwardly directed, open cup-shaped portion 14A of bearing 14 and the space contained within the lower skirt portion 11S of the displacer 11 below the connecting web 13 (assumed to be impermeable) define a closed, expandable and contractable chamber that forms an upper, displacer end gas spring for springing rod 12 and displacer 11 to ground through bearing 14 and the housing of the Stirling engine in which it is contained. This displacer end gas spring is identified by the reference numeral 15. The space contained within the downwardly depending cup-shaped portion 14B of bearing 14 and the enclosed space within the piston area end 12A and its upwardly extending skirt portion 12S of rod 12 also defines a further chamber which is both expandable and contractable with the reciprocal motion of the displacer 11 and rod 12 assembly. This further expandable and contractable gas chamber forms a second gas spring identified as 16.

The gas springs 15 and 16 form a set of opposed-acting gas springs in that while the displacer 11 and rod 12 assembly move upwardly, gas spring space 15 will expand and gas spring space 16 will contract to provide spring stiffness such that when combined with the displacer and rod a spring-mass system having a natural frequency substantially the same as the desired operating frequency for the Stirling engine, is formed.

Conversely, during downward reciprocal movement of displacer 11 and rod 12, the gas spring space 16 will expand while the space 15 contracts giving the same result as above, but in the opposite direction.

In the displacer and rod assembly shown in FIG. 1, the displacer is sprung to ground via gas springs 15 and 16 and bearing member 14 to the Stirling engine housing. The rod "area" which determines the actual thermodynamic power imparted to the displacer, is actually the unbalanced area between the seal diameters of the two gas springs 15 and 16. Since this is different from the area of any distinct part it is a "virtual" rod area. These seal diameters are shown in FIG. 1 as $D_1$ and $D_2$. The virtual rod area ($A_r$) which determines the thermodynamic power imparted to the displacer is given by the following expression:

$$A_r=\pi/4(D_1^2-D_2^2) \quad (1)$$

The "virtual rod" area stressed in equation (1) above causes the same force as the rod area provided in known designs; however, the virtual rod design shown in FIG. 1 allows the internal rod 12 to be sized according to optimum structural and bearing criteria for a given Stirling engine output power rating. Further, the creation of the two gas springs 15 and 16 provides greater stiffness than with previously known designs without excessive loss and non-linearity due to high gas spring pressure ratios. This results in better gas spring action while at the same time allowing bearing size selection based on the load to be accommodated while employing smaller rod areas than otherwise previously practical. It should be further noted that from FIG. 1 as well as from FIG. 2 to be explained hereafter, the effective rod area actually can be designed to go to zero (or even "negative") without sacrificing mechanical integrity of the assembly. With "negative" rod area, the hot and cold ends may be interchanged if advantageous e.g. in a heat pump.

Figure 2:
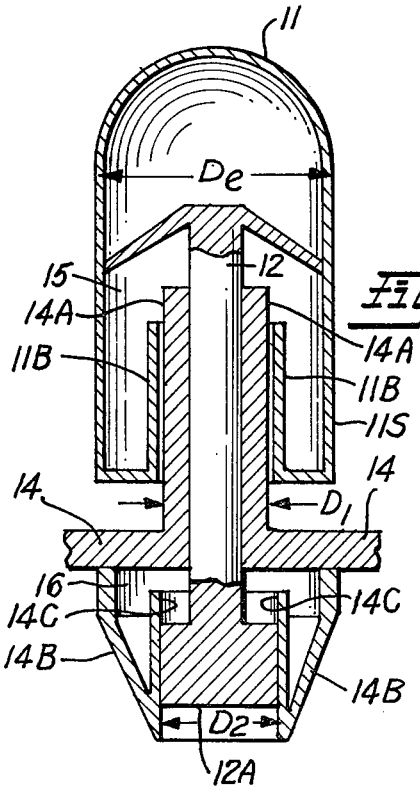
FIG. 2 is a schematic, longitudinal sectional view of a second, preferred embodiment of a virtual rod displacer assembly constructed according to the invention.

FIG. 2 of the drawings illustrates a preferred embodiment of a virtual rod assembly according to the invention whereby it is possible to vary the virtual rod area easily by changing two parts of the displacer and rod assembly. In FIG. 2, the displacer 11 is secured to rod 12 by the impermeable web 13 and has an up-turned, cup-shaped sealing surface portion 11B which is integrally formed with the skirt portion 11S. The up-turned, cup-shaped sealing portion 11B of displacer 11 is slidably associated with the upwardly extending sealing portion 14A of bearing 14 that journals rod 12. The mating surfaces of up-turned sealing portion 14A and the cup-shaped sealing portion 11B of displacer 11 form a close fitting seal so that an expansible and contractable chamber is formed which defines the displacer end gas spring 15 in the FIG. 2 assembly.

Figure 4:
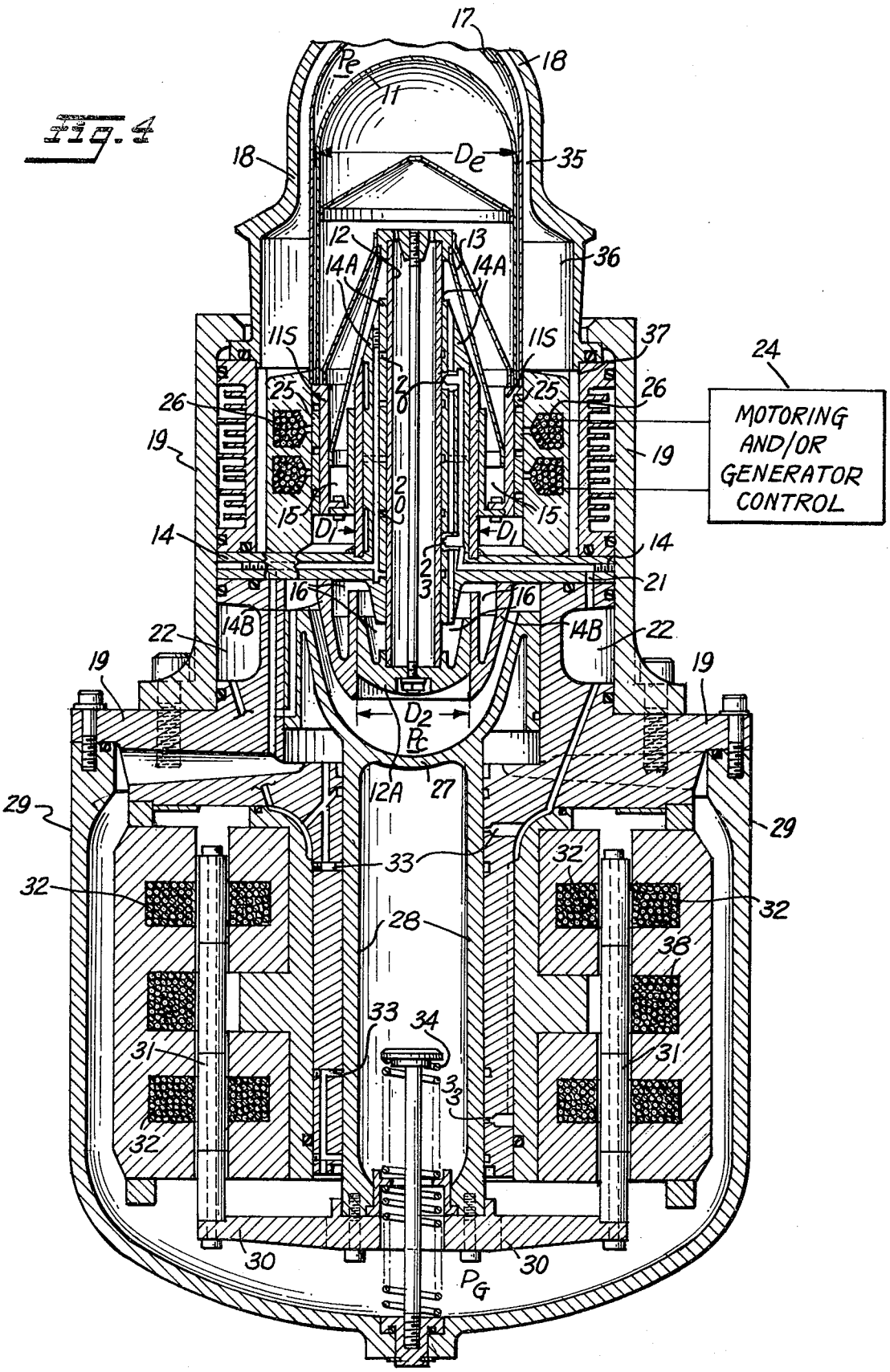
FIG. 4 is a longitudinal sectional view of a new and improved resonant free-piston Stirling engine according to the invention having a virtual rod displacer assembly and a displacer linear electrodynamic machine for controlling operation of the resonant free-piston Stirling engine.
Figure 5:
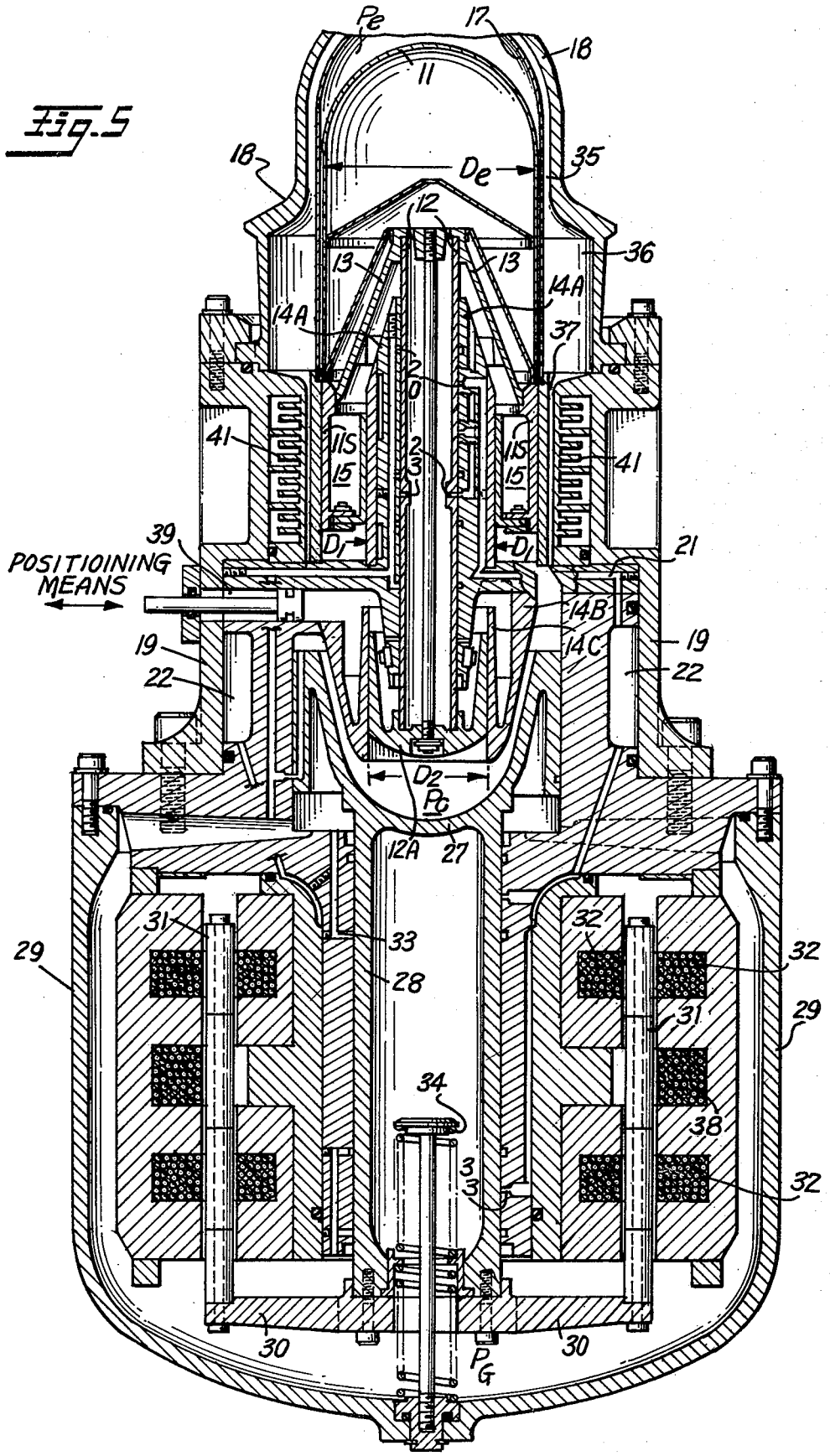
FIG. 5 is a longitudinal sectional view of a new and improved resonant free-piston Stirling engine employing a novel virtual rod displacer assembly according to the invention, and which operates conventionally in the manner of a pure thermodynamic driven resonant free-piston Stirling engine.

The lower end of rod 12 in FIG. 2 terminates in a piston portion having a piston area 12A that is subjected to the working gas periodic pressure wave produced within the Stirling engine housing as will be shown more clearly hereafter with respect to FIGS. 4 and 5. The piston portion 12A is slidably associated with an up-turned lower cylinder portion 14C that is integral with and appended to the lower end of the downwardly depending skirt portion 14B of bearing member 14. Here again, the mating surfaces of the piston portion 12A and rod 12 and the up-turned lower bearing portion 14C form a close fitting seal to define an expansible/contractable chamber that forms the piston end gas spring 16. In operation, the embodiment of the invention shown in FIG. 2 functions in the same manner as the embodiment shown in FIG. 1.

Figure 3A:
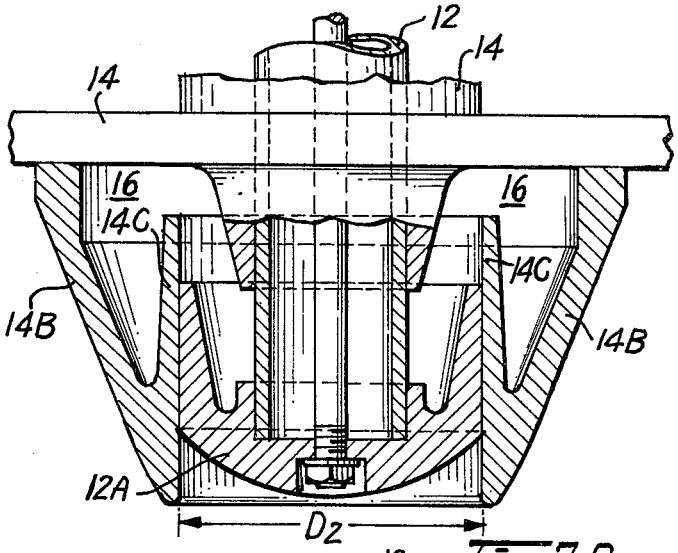
FIGS. 3A, 3B and 3C are partial, longitudinal sectional view of the lower piston area end of the displacer rod, and illustrate the manner in which the lower piston end of the displacer rod assembly can by design be differently dimensioned in order to tailor the virtual rod drive assembly for different applications or control strategies.
Figure 3B:
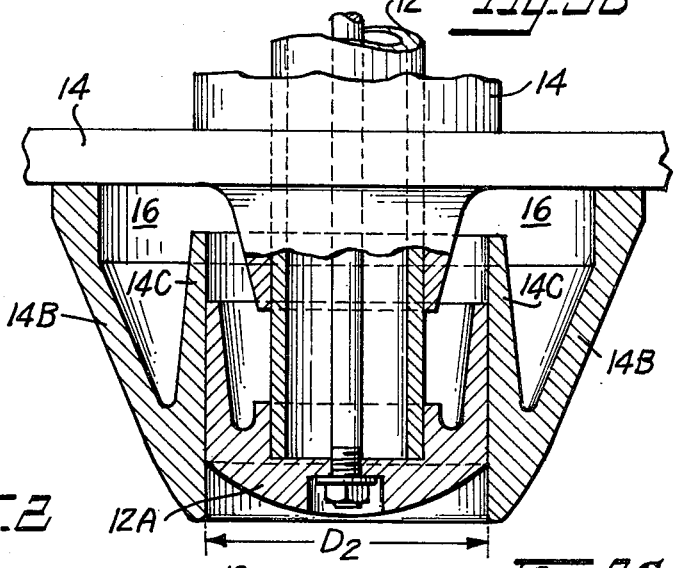
Figure 3C:
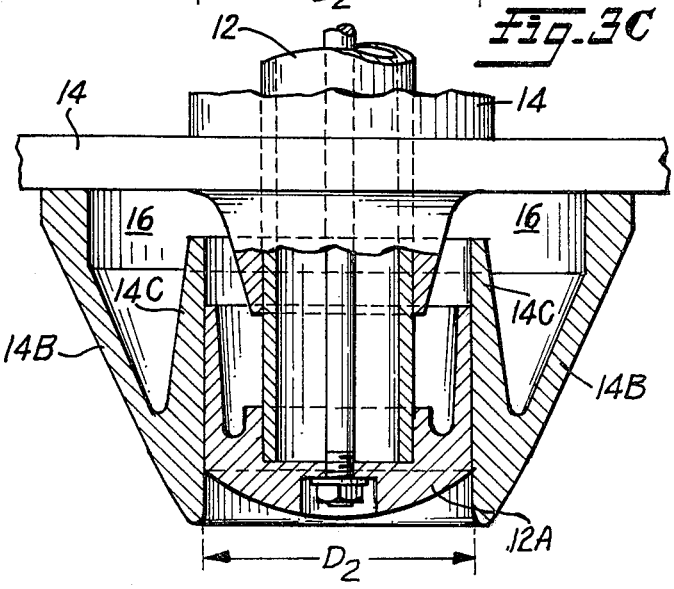

FIGS. 3A, 3B and 3C are partial sectional views of the lower piston end of rod 12 of the displacer and rod assembly shown in FIG. 2 and respectively show a construction whereby the effective rod area of the virtual rod displacer readily can be changed by changing the diameter $D_2$ of the piston end of rod 12 along with the lower depending skirt portion 14B and upwardly extending cup-shaped cylinder portion 14C of bearing member 14. The construction shown in FIG. 3A provides a piston end diameter $D_2$ having a value of about 2.135 inches and corresponds to a zero rod area for a particular embodiment. The construction shown in FIG. 3B provides a piston rod diameter $D_2$ of about 2.084 inches and is exemplary of a virtual rod displacer assembly constructed for use with a displacer linear electrodynamic machine for a comparable embodiment as will be described hereafter with relation to FIG. 4. FIG. 3C is illustrative of a virtual rod assembly construction in accordance with FIG. 2 wherein the rod piston diameter is of the order of 1.950 inches suitable for use with a comparable machine where the displacer is thermodynamically driven only, such as is illustrated in FIG. 5.

FIG. 4 is a longitudinal sectional view of a resonant free-piston Stirling engine constructed in accordance with the invention and which includes the novel virtual rod displacer assembly shown schematically in FIGS. 2 and 3B for use with a displacer linear electrodynamic machine. The engine shown in FIG. 4 includes a displacer 11 which is mounted for up and down reciprocation within a hermetically sealed outer vessel 18 and having an inner shell 17 for heating a charge of working gas enclosed within a working space formed within the Stirling engine housing and including the interior of shell 17. Shell 17 is supported within vessel 18 that is mounted on and comprises a part of the upper housing 19 of the Stirling engine. A heat source (not shown) such as a combustor or other source of heat (eg. a solar collector) which may be of the type disclosed in U.S. patent application Ser. No. 172,373, Filed: July 25, 1980,—John J. Dineen, et. al.—inventors, entitled, "Diaphragm Displacer Stirling Engine Powered Alternator-Compressor" and assigned to Mechanical Technology Incorporated, now U.S. Pat. No. 4,380,152 heats the working gas within vessel 18. Hot gases of combustion from the combustor flow around the exterior of the vessel 18 and then are exhausted back out through the exhaust ports of the heat exchanger during operation of the engine. The hot combustion gases cause the working gas contained within the interior of vessel 18 to be continuously heated and expanded as denoted by the reference letter $P_e$.

The displacer 11 is mounted for reciprocal up-down movement within shell 17 and is secured to a rod 12 by means of the impervious web 13 similar to the displacer and rod assembly shown in FIG. 2. The rod 12 is vertically supported for up-down reciprocal movement within an upstanding tubular bearing portion 14A of a bearing member 14 that is secured to and comprises a part of the upper housing 19 of the Stirling engine. The rod 12 is supported within the upstanding tubular-like bearing portion 14A by means of gas bearings whose ports are indicated at 20 in FIG. 4 and which are supplied from a suitable source of pressurized bearing gas comprising chambers 22 contained within housing 19 via interconnecting air passageways 21 formed within bearing member 14 and the upstanding tubular-like rod support bearing 14A. For a more detailed description of the construction and operation of a suitable air bearing structure, reference is made to co-pending U.S. Application Ser. No. 168,716, Filed: July 14, 1980, in the name of Jeffrey S. Rauch for a "Free-Piston Stirling Engine Power Control" assigned to Mechanical Technology Incorporated, now U.S. Pat. No. 4,408,456 the disclosure of which is hereby incorporated into the disclosure of this application in its entirety.

The rod 12 has secured to its lower end a rod piston 12A whose details of construction are best shown in FIG. 3B of the drawings. The rod piston 12A is mounted for up and down reciprocation within the upstanding, cylindrically-shaped portion 14C of downwardly depending skirt portion 14B of bearing member 14. As described above with relation to FIG. 2 of the drawings, piston 12A and bearing member 14 together with its downwardly depending skirt portion 14B and upwardly directed, cylindrically-shaped portion 14C acting in conjunction with the rod piston 12A define and form the lower rod piston area gas spring 16. Opposing the rod piston area gas spring 16 is the displacer end gas spring volume 15 that is defined by the exterior surfaces of the upstanding, cylindrically-shaped bearing portion 14A of bearing member 14 and impervious web 13 that secures rod 12 to the lower skirt portion 11S of displacer 11. As described more fully in the above-referenced U.S. Application Ser. No. 168,716, now U.S. Pat. No. 4,408,456, the interior of rod 12 is hollow and includes a porting arrangement shown generally at 23 which interconnects the two opposing gas spring volumes 15 and 16 to each other and to the interior volume of displacer 11 at substantially the midstroke position of displacer 11 and rod 12. For a more detailed description of the construction and operation of a similar midstroke, pressure equalizing, porting feature, reference is made to the above-noted U.S. Application Ser. No. 168,716, now U.S. Pat. No. 4,408,456.

As noted above, the working space within the Stirling engine contains a working gas that is heated and expanded in the upper heated end of the Stirling engine denoted generally by the space between the inside of shell 17 and the outer surface of displacer 11 as indicated by the reference character $P_e$. This space communicates through narrow passageways 35 extending downwardly along the sides of vessel 18 between shell 17 and vessel 18 through a suitable regenerator 36 and cooler 37 to a cool space denoted by the reference character $P_c$ which is exposed to the surface of rod piston area 12A and the upper surface of a working member or power piston 27.

In operation, a pressure wave is produced in the working gas contained within the working space to drive the working member or power piston 27 to thereby produce output power from the engine. The pressure wave in the working gas is produced in the classical Stirling cycle by heating the gas in the regenerator at constant volume, expanding the gas in the expansion spaces $P_e$ at constant temperature, cooling the gas in the regenerator at constant volume, and compressing the gas in the compression spaces $P_c$ at constant temperature. To approximate this cycle, a heater composed of passages 35 is incorporated into the vessel 18 and a cooler composed of passages 37 is attached to the cool end of the engine approximately in the vicinity of the bearing member 14. To cause the working gas to flow between the hot space inside the heater head at the hot or expansion end of the engine and the cool space at the cool or compression end of the engine, the displacer 11 is disposed in the working space with its upper end exposed to the expansion space $P_e$ and with the lower piston rod area 12A of rod 12 exposed to the compression space $P_c$ of the working gas. In operation, displacer 11 oscillates axially up and down in a reciprocating motion to displace the working gas to and fro between the hot and cold spaces to thereby produce the periodic pressure wave.

The resonant, free-piston Stirling engine shown in FIG. 4 further includes a displacer linear electrodynamic machine having a permanent magnet armature shown at 25 in FIG. 4 secured to and movable with the lower displacer skirt portion 11S of displacer 11. The permanent magnet armature 25 is disposed opposite windings shown at 26 which in the embodiment described are stator windings and are electrically excited with excitation signals having substantially the same frequency as the desired frequency of operation of the Stirling engine. The permanent magnet, displacer linear electrodynamic machine is otherwise of conventional construction except for its adaptation and mounting of the armature thereof on the displacer of the Stirling engine and is generally of the type described more fully in U.S. patent application Ser. No. 168,716, now U.S. Pat. No. 4,408,456 the disclosure of which has been incorporated into this application in its entirety. The displacer linear electrodynamic machine as described above is a general purpose machine capable of operation either as a linear electric motor or as a linear electric generator. Coupled to the stator windings of the machine is a motoring and/or generator control 24 for supplying to the stator windings suitable electrical excitation signals for selectively and controllably causing the linear electrodynamic machine to function either as a generator load to extract power from the displacer and rod assembly whereby the displacer is caused to move with a greater phase angle relative to the power piston (working member) of the Stirling engine and/or a reduced stroke and the engine operation is dampened. Alternatively, control 24 can be set to cause the displacer linear electrodynamic machine 25, 26 to operate as an electric drive motor to apply additional input power to the displacer and rod assembly whereby the displacer is caused to move with increased stroke and/or smaller phase angle relative to the power piston (working member) of the Stirling engine and increased power output can be derived from the engine. The motoring and/or generator control 24 may comprise any conventional linear motor control having the capability of causing the linear electrodynamic machine 25, 26 selectively to function either as a motor or generator as described above. For a detailed description of a suitable motor/generator control 24, reference is made to co-pending U.S. patent application Ser. No. 402,303 filed concurrently herewith, entitled "Start-Up and Control Method and Apparatus for Resonant Free-Piston Stirling Engine"—Michael M. Walsh—inventor and assigned to Mechanical Technology Incorporated, the disclosure of which is hereby incorporated into this application in its entirety.

In addition to operating selectively either as a drive motor to drive the displacer rod assembly, or alternatively to act as a load and dampen the displacer and rod assembly, the linear electrodynamic machine 25, 26 can be employed during starting of the Stirling engine to initially start reciprocation of the displacer 11 and rod 12 drive assembly by simply placing the machine in the drive motor mode of operation while simultaneously implementing the thermodynamic inputs to the Stirling engine as described earlier.

The power piston or working member 27 has a depending integrally formed rod 28 supported within a lower housing 29 secured to the upper housing 19. Rod 28 has a disk 30 secured to its lower end which in turn supports a cylindrical armature 31 within the lower housing 29. The armature 31 is disposed between stator windings 32 of a load generator supported within the lower housing 29 and acts as a movable path for magnetic flux induced by field windings 38. Electrical terminals (not shown) supply electric energy generated by the load generator 31, 32 as the form of output power derived from the resonant free-piston Stirling engine. It should be noted that the particular design of the load generator is not important insofar as the present invention is concerned since any suitable form of linear electrical generator could be mounted to reciprocate with the power piston 27. If desired, an entirely different type of load such as a linear gas compressor of the type disclosed in U.S. patent application Ser. No. 168,716, now U.S. Pat. No. 4,408,456, could be employed in place of the linear electrical generator or a linear hydraulic pump, etc. suitably could be driven by the Stirling engine made available by this invention. The power piston rod 28 is supported for reciprocal up-down movement within lower housing 29 by suitable gas bearings shown at 33 supplied from the bearing gas supply plenums 22 in the upper end of the engine. A centering and return spring system 34 secured between the lower end of the power piston rod 28 and the lower end of lower housing 29 assures that the cylindrically shaped armature 31 of the load generator will be suitably centered as a convenience when initially starting the equipment.

In operation, the Stirling engine/generator combination is initially started by placing the displacer linear electrodynamic machine 25, 26 in the motoring mode to drive the displacer and rod assembly 11, 12 up and down. Simultaneously, thermodynamic input in the form of heat is applied to vessel 18 and causes the working gas entrapped in the space labeled with the reference character $P_e$ to be heated, increase system pressure and to expand. The increase in system pressure exerts force on both the displacer and rod assembly 11, 12 and the power piston (working member) 27 driving them downwardly. The differential force on the displacer is due to the unequal end areas (virtual rod area) exposed to system pressure. The force on the power piston is due to the differential pressure between the compression space $P_c$ and the generator cavity $P_g$ acting on the face of power piston 27. As the displacer moves downwardly, gas is shuttled from the compression space $P_c$ to the expansion space $P_e$. As the mass of working gas in the expansion space continues to increase, the system pressure increases further, driving the displacer assembly 11, 12 further down at an increasing rate while storing energy in the displacer gas springs 15, 16.

Because of the greater mass of the output member composed of the power piston 27 and associated rod 28, disc 30 and armature 31, the output member will react more slowly causing the displacer 11 to reach full downward position before the output member. The gas in the expansion space $P_e$ continues to expand driving the output member further downward. At this point, the system pressure has fallen far enough so that energy stored in the displacer gas springs 15, 16 causes the displacer 11 to begin to move upwardly. As the displacer moves upwardly, it shuttles gas from the expansion space $P_e$ through the regenerator 36 and cooler 37 to the compression space $P_c$.

As heat is removed from the gas by the regenerator 36 and the cooler 37, the system pressure drops more causing the displacer 11 to move further into the expansion space $P_e$. At this point, the pressure in the compression space $P_c$ drops below the pressure in the generator space $P_g$, and the working member, driven by the energy stored in the generator space $P_g$ recompresses the gas in the compression space $P_c$. This increase in pressure in the engine causes the displacer 11 to begin moving downwardly, repeating the cycle previously described. This up and down motion results in changing the magnetic field threading the stator windings 32 so as to produce electrical power for supply to a user of the output power being generated by the equipment.

For a more detailed explanation of the thermodynamics involved in the operation of a free-piston Stirling engine reference is made to the above-noted textbook by G. Walker and U.S. patent application Ser. No. 168,716, now U.S. Pat. No. 4,408,456, particularly with regard to the portion of the specification thereof dealing with FIG. 7 and the phasor diagrams of FIG. 8.

The power output derived from the engine/load combination is a direct function of the phase angle between movement of the displacer and the power piston (working member). If it is desired to increase the power output derived from the generator 31, 32, the motoring and/or generator control 24 is selectively operated to cause the displacer linear electrodynamic machine 25, 26 to function as a motor to help drive the displacer and rod assembly thereby closing the phase angle between the displacer and the power piston and/or increasing displacer stroke to thereby increase power output from the equipment. Conversely, if it is desired to reduce power output, the motoring and/or generator control 24 is selectively operated to cause the displacer linear electrodynamic machine 25, 26 to function as a generator thereby loading and damping movement of the displacer and rod assembly and/or decrease the displacer stroke to thereby decrease power output from the equipment.

FIG. 5 of the drawings is a longitudinal sectional view of an all thermodynamic resonant free-piston Stirling engine having a virtual rod displacer assembly constructed according to the invention. In FIG. 5, corresponding parts of the engine to those described with relation to FIG. 4 have been given the same reference numeral and hence need not be described again. The essential difference in the pictorial representations of FIG. 5 and FIG. 4 is that the orientation of the engine relative to the third dimension not shown in the figures has been rotated somewhat to better show and illustrate the construction of the cooler required in both engines but absolutely essential in all thermodynamic Stirling engines. The cooler components are illustrated generally at 41 and the construction and operation of the cooler is described more completely in U.S. patent application Ser. No. 168,716, now U.S. Pat. No. 4,408,456 the disclosure of which has been incorporated into this application in its entirety.

In the embodiment of the invention shown in FIG. 5, no externally driven or loaded linear electrodynamic machine is used with the displacer and hence those components have been eliminated from the figure. In their place a variable displacer spring has been shown, but other control methods (eg. variable damping) may be employed.

Another important difference between the two Stirling engines shown in FIGS. 4 and 5 is the dimensioning of the lower piston rod end of the virtual rod displacer assembly. In FIG. 5 engine, the lower rod piston 12A together with its associated bearing assembly 14B and 14C have been altered from that shown in FIG. 4 to substitute the smaller diameter lower piston rod assembly illustrated in FIG. 3C of the drawings. This is accomplished by merely unthreading the screw nut on the end of the bolt which holds the rod piston 12A in place and replacing it with the smaller diameter rod piston used with the purely thermodynamic undriven or unloaded resonant free-piston Stirling engine. Additionally, the associated cylindrically-shaped surface portion 14C is changed by unfastening the structure previously employed and refastening the different sized cylinder assembly required.

In all other respects the engine and generator loads shown in FIG. 5 are constructed similar to and operate in the same manner as was described briefly with respect to FIG. 4 with the notable exception that no linear displacer electrodynamic machine is employed to either drive or dampen operation of the resonant free-piston Stirling engine. In its place, the engine shown in FIG. 5 employs an adjustable gas spring volume control 39 which is similar in construction and operation to the volume control 185 described and illustrated more fully in the above-referenced U.S. Application Ser. No. 168,716, now U.S. Pat. No. 4,408,456 the disclosure of which has been incorporated into this application. The positioning means employed in operating control 39 is not shown in the drawing in order to avoid undue complexity and in view of the fact such positioning means in clearly disclosed in co-pending U.S. Application Ser. No. 168,716, now U.S. Pat. No. 4,408,456.

From the foregoing description it will be appreciated that the invention provides a new and improved virtual rod displacer assembly for resonant free-piston Stirling engines which can be employed in a variety of different engine designs for handling different type loads under widely different conditions. The invention makes possible the provision of a new and improved resonant free-piston Stirling engine using the virtual rod displacer which is particularly well suited for use in conjunction with a displacer linear electrodynamic machine for controlling operation of the resonant free-piston Stirling engine. However, the virtual rod displacer may be used on engines either with or without such a displacer linear electrodynamic machine motor drive/generator. The virtual rod displacer makes it possible to design engines having widely different bearing sizes based on anticipated load range and yet provides better gas spring action using smaller displacer rod area than was possible with previously known displacer rod designs.

INDUSTRIAL APPLICABILITY

The invention relates to resonant, free-piston Stirling engines and combination power packages employing such engines as the primary moving source in conjunction with electrical generators, compressors, hydraulic pumps and other similar apparatus for residential, commercial and industrial uses.

Having described several embodiments of a new and improved virtual rod displacer constructed in accordance with the invention together with new and improved resonant free-piston Stirling engines employing the virtual rod displacer and methods of operation of such Stirling engines, it is believed obvious that changes, additions and deletions may be made to the particular embodiments of the invention described which are within the full intended scope of the invention, as defined by the appended claims.

What is claimed is:

1. A new and improved virtual rod displacer assembly for a resonant free-piston Stirling engine having a reciprocally movable displacer that is exposed to a working gas pressure wave periodically produced within the Stirling engine, said pressure wave driving a working member by which work is derived from the engine, a rod secured to and reciprocally movable with said displacer within the Stirling engine, a rod piston area formed on the end of said rod remote from the displacer and also subjected to the working gas periodic pressure wave, bearing means secured to the Stirling engine housing for reciprocatingly supporting said displacer and rod assembly within the Stirling engine, said bearing means in conjunction with said rod, said engine housing and said rod piston defining a set of opposed-acting gas spring means acting on said displacer and rod assembly to provide a spring-mass system capable of reciprocating motion at a natural frequency substantially the same as the desired operating frequency of the engine.

2. A virtual rod displacer assembly for a resonant free-piston Stirling engine according to claim 1, wherein one end of said displacer has a greater effective area acted upon by the gas contained within the engine than the effective area of the opposite end of said displacer acted upon by the working gas in the engine, whereby the unbalanced areas of the opposing ends of said displacer create a differential force acting upon and reciprocating the displacer and rod assembly as a result of periodic changes in engine pressure.

3. A virtual rod displacer assembly for a resonant free-piston Stirling engine according to claim 1, wherein one of said set of opposed gas spring means is comprised by a closed displacer skirt portion of greater diameter than the rod attached to and reciprocally movable with said displacer and wherein said housing means includes a displacer skirt sealing portion or post secured to the Stirling engine housing and circumferentially surrounding the rod for slidably engaging the skirt portion of the displacer during reciprocal movement thereof with the displacer, said closed displacer skirt portion and said post sealing means defining a periodically expandable and contractable closed gas chamber adjacent the displacer end of the rod that forms one of the opposing gas spring means during reciprocal movement of the displacer and rod assembly.

4. A virtual rod displacer assembly for a resonant free-piston Stirling engine according to claim 3, wherein the other of said set of opposed gas spring means is comprised by the rod piston area formed on the end of said rod remote from the displacer, and wherein the housing means includes a rod piston end sealing portion or cylinder secured to the Stirling engine housing and slidably engaging the piston end of the rod, said rod piston end cylinder having a circumferential chamber of greater diameter than the rod surrounding the rod and communicating with the underside of the rod on which said piston area is formed to define a periodically expandable and contractable closed gas chamber adjacent the piston area end of the rod.

5. A virtual rod displacer assembly for a resonant free-piston Stirling engine according to claim 4, wherein one end of said displacer means has a greater effective area acted upon by the gas contained within the engine than the effective area of the opposite end of said displacer acted upon by gas within the engine whereby the unbalanced areas of the opposing ends of said displacer means create a differential force acting upon and reciprocating the displacer and rod assembly as a result of changes in engine pressure.

6. A virtual rod displacer assembly for a resonant free-piston Stirling engine according to claim 1, further including gas porting means formed on said rod means and selectively communicating through said rod with the interior of said displacer means and through said housing with both of the opposing gas spring means for equalizing pressure in said displacer means and in said opposed acting gas spring means as the displacer and rod assembly passes through a substantially midstroke position during reciprocal movement thereof.

7. A virtual rod displacer assembly for a resonant free-piston Stirling engine according to claim 5, further including gas porting means formed on said rod means and selectively communicating through said rod with the interior of said displacer means and through said housing with both of the opposing gas spring means for equalizing pressure in said displacer means and in said opposing gas spring means as the displacer and rod assembly passes through a substantially midstroke position during reciprocal movement thereof.

8. A virtual rod displacer assembly for a resonant free-piston Stirling engine according to claim 1, further including displacer linear electrodynamic machine means having an armature secured to and movable with the displacer and rod assembly and having a stator supported by the Stirling engine housing in juxtaposition to said armature and means for electrically exciting the displacer linear electrodynamic machine means with electrical excitation signals having substantially the same frequency as the desired frequency of operation of the Stirling engine.

9. A virtual rod displacer assembly for a resonant free-piston Stirling engine according to claim 7, further including displacer linear electrodynamic machine means having an armature secured to and movable with the displacer and rod assembly and having a stator supported by the Stirling engine housing a juxtaposition to said armature and means for electrically exciting the displacer linear electrodynamic machine means with electrical excitation signals having substantially the same frequency as the desired frequency of operation of the Stirling engine.

10. A virtual rod displacer assembly for a resonant free-piston Stirling engine according to claim 8, wherein said displacer linear electrodynamic machine means is designed as a general purpose machine capable of operation either as a linear electric motor or as a linear electric generator and further including selectively operable electric control means for selectively and controllably causing said electrodynamic machine means to function either as a generator load to extract power from the displacer and rod assembly whereby the displacer is caused to move with reduced amplitude and/or a greater phase angle relative to the working member of the Stirling engine and engine operation is dampened, or alternatively selectively causing the displacer electrodynamic machine means to operate as an electric drive motor to apply additional input power to the displacer and rod assembly whereby the displacer is caused to move with increased amplitude and/or a smaller phase angle relative to the working member of the Stirling engine and increased power output can be derived from the engine.

11. A virtual rod displacer assembly for a resonant free-piston Stirling engine according to claim 9, wherein said displacer linear electrodynamic machine means is designed as a general purpose machine capable of operation either as a linear electric motor or as a linear electric generator and further including selectively operable electric control means for selectively and controllably causing said electrodynamic machine means to function either as a generator load to extract power from the displacer and rod assembly whereby the displacer is caused to move with reduced amplitude and/or a greater phase angle relative to the working member of the Stirling engine and engine operation is dampened, or alternatively selectively causing the displacer electrodynamic machine means to operate as an electric drive motor to apply additional input power to the displacer and rod assembly whereby the displacer is caused to move with increased amplitude and/or a smaller phase angle relative to the working member of the Stirling engine and increased power output can be derived from the engine.

12. A virtual rod displacer assembly for a resonant free-piston Stirling engine according to claim 10, wherein said displacer linear electrodynamic machine means also serves as a means for readily starting the resonant free-piston Stirling engine.

13. A virtual rod displacer assembly for a resonant free-piston Stirling engine according to claim 11, wherein said displacer linear electric electrodynamic machine means also serves as a means for readily starting the resonant free-piston Stirling engine.

14. In a resonant free-piston Stirling engine having a vessel for heating a charge of working gas enclosed within a working space formed in the Stirling engine housing and including the interior of the vessel, said working gas being heated by the vessel at one end of the working space and cooled by a cooler at the other end, the working gas being shuttled back and forth from the heated end to the cooled end of the working space via a regenerator and cooler by a displacer which reciprocates axially within the Stirling engine housing to generate a periodic pressure wave in the working gas, the periodic pressure wave acting upon and driving a working member reciprocally mounted within the Stirling engine and from which output work from the engine is derived; the improvement comprising a rod secured to and reciprocatingly movable with said displacer within the Stirling engine, a piston area formed on the end of the rod remote from the displacer and also subjected to the working gas periodic pressure wave, bearing means secured to the Stirling engine housing for reciprocatingly supporting said displacer and rod assembly within the Stirling engine, said bearing means in conjunction with said rod, said rod piston and said engine housing defining a set of opposed-acting gas spring means acting on said displacer and rod assembly to provide a spring-mass system within the Stirling engine having a natural frequency of oscillation substantially the same as the desired frequency of operation of the Stirling engine.

15. A resonant free-piston Stirling engine according to claim 14, wherein one end of said displacer means has a greater effective area acted upon by the gas contained within the engine than the effective area at the opposite end acted upon by gas within the engine whereby the unbalanced areas of the opposing ends of said displacer means create a differential force acting upon the reciprocatingly movable displacer and rod assembly as a result of changes in engine pressure.

16. A resonant free-piston Stirling engine according to claim 15, wherein said one of said set of opposed gas spring means is comprised by a closed displacer skirt portion of greater diameter than the rod attached to and reciprocally movable with said displacer and wherein said housing means includes a displacer skirt sealing portion or post secured to the Stirling engine housing and circumferentially surrounding the rod for slidably engaging the skirt portion of the displacer during reciprocal movement thereof with the displacer, said closed displacer skirt portion and said post means defining a periodically expandable and contractable closed gas chamber adjacent the displacer end of the rod, said gas chamber forming one of the opposing gas spring means during reciprocal movement of the displacer and rod assembly.

17. A resonant free-piston Stirling engine according to claim 16, wherein the other of said set of opposed gas spring means is comprised by the rod piston area formed on the end of said rod remote from the displacer, and wherein the housing means includes a rod piston end sealing portion or cylinder secured to the Stirling engine housing and slidably engaging the piston end of the rod, said rod piston end cylinder having a circumferential chamber of greater diameter than the rod, surrounding the rod and communicating with the underside of said piston area to define a periodically expandable and contractable closed gas chamber adjacent the piston area end of the rod.

18. A resonant free-piston Stirling engine according to claim 17, further including gas porting means formed on said rod means and selectively communicating through said rod with the interior of said displacer means and through said housing with both of the opposing gas spring means for equalizing pressure in said displacer means and in said opposed acting gas spring means as the displacer and rod assembly passes through a substantially midstroke position during reciprocal movement thereof.

19. A resonant free-piston Stirling engine according to claim 15, further including displacer linear electrodynamic machine means having an armature secured to and movable with the displacer and rod assembly and having a stator supported by the Stirling engine housing in juxtaposition to said armature and means for electrically exciting the displacer linear electrodynamic machine means with electrical excitation signals having substantially the same frequency as the desired frequency of operation of the Stirling engine.

20. A resonant free-piston Stirling engine according to claim 18, further including displacer linear electrodynamic machine means having an armature secured to and movable with the displacer and rod assembly and having a stator supported by the Stirling engine housing in juxtaposition to said armature and means for electrically exciting the displacer linear electrodynamic machine means with electrical excitation signals having substantially the same frequency as the desired frequency of operation of the Stirling engine.

21. A resonant free-piston Stirling engine according to claim 19, wherein said displacer linear electrodynamic machine means is designed as a general purpose machine capable of operation either as a linear electric motor or as a linear electric generator and further including selectively operable electric control means for selectively and controllably causing said electrodynamic machine means to function either as a generator load to extract power from the displacer and rod assembly whereby the displacer is caused to move with reduced amplitude and/or with a greater phase angle relative to the working member of the Stirling engine and engine operation is dampened, or alternatively selectively causing the displacer electrodynamic machine means to operate as an electric drive motor to apply additional input power to the displacer and rod assembly whereby the displacer is caused to move with increased amplitude and/or a smaller phase angle relative to the working member of the Stirling engine and increased power output can be derived from the engine.

22. A resonant free-piston Stirling engine according to claim 20, wherein said displacer linear electrodynamic machine means is designed as a general purpose machine capable of operation either as a linear electric motor or as a linear electric generator and further including selectively operable electric control means for selectively and controllably causing said electrodynamic machine means to function either as a generator load to extract power from the displacer and rod assembly whereby the displacer is caused to move with a greater phase angle relative to the working member of the Stirling engine and/or reduced stroke and engine operation is dampened, or alternatively selectively causing the displacer electrodynamic machine means to operate as an electric drive motor to apply additional input power to the displacer and rod assembly whereby the displacer is caused to move with a smaller phase angle relative to the working member of the Stirling engine and/or increased stroke and increased power output can be derived from the engine.

23. A resonant free-piston Stirling engine according to claim 21, wherein said displacer linear electric electrodynamic machine means also serves as a means for readily starting the resonant free-piston Stirling engine.

24. A resonant free-piston Stirling engine according to claim 22, wherein said displacer linear electric electrodynamic machine means also serves as a means for readily starting the resonant free-piston Stirling engine.

25. The method of operating a resonant free-piston Stirling engine of the type having a heating vessel for heating a charge of working gas enclosed within a working space formed in the Stirling engine housing and which further includes the interior of the vessel, said working gas being heated by the vessel at one end of the working space and cooled by a cooler at the other end, the working gas being shuttled back and forth from the heated end to the cooled end of the working space by a displacer and rod assembly which reciprocates axially within the Stirling engine housing to generate a periodic pressure wave in the working gas, the periodic pressure wave acting upon a work producing member to derive output power from the engine, said method comprising forming different effective areas on opposing ends of the displacer and rod assembly and establishing the relative effective force produced by the respective opposed effective areas exposed to the periodic pressure wave so as to derive a desired designed thermodynamic power output level from the engine, and forming opposing gas springs acting on the displacer and rod assembly for springing the displacer and rod assembly to ground during the reciprocating travel thereof.

26. The method according to claim 25, wherein one of the set of opposed effective end areas is dimensioned to provide a relative larger effective force which acts upon the reciprocatingly movable displacer and rod assembly.

27. The method according to claim 26, wherein the effective gas pressure in each of the set of opposing gas springs is substantially equalized as the reciprocally moving displacer and rod assembly pass substantially through the midstroke position of the reciprocating path of travel thereof.

28. The method according to claim 25, employing a resonant free-piston Stirling engine which further includes a displacer linear electrodynamic machine having an armature secured to and movable with the displacer and rod assembly and having a stator supported by the Stirling engine housing in juxtaposition to said armature and wherein the method further comprises electrically exciting the displacer linear electrodynamic machine with electrical excitation signals having substantially the same frequency as the desired frequency of operation of the Stirling engine.

29. The method according to claim 27, employing a resonant free-piston Stirling engine which further includes a displacer linear electrodynamic machine having an armature secured to and movable with the displacer and rod assembly and having a stator supported by the Stirling engine housing in juxtaposition to said armature and wherein the method further comprises electrically exciting the displacer linear electrodynamic machine with electrical excitation signals having substantially the same frequency as the desired frequency of operation of the Stirling engine.

30. The method according to claim 28, wherein the displacer linear electrodynamic machine is designed as a general purpose machine capable of operation either as a linear electric motor or as a linear electric generator wherein the electrodynamic machine is selectively and controllably operated either as a generator load on the displacer and rod assembly to decrease the stroke and/or increase the phase angle between the displacer and the work producing member of the Stirling engine to thereby decrease the power output of the engine or alternatively to operate as a motor for driving the displacer and rod assembly to increase the stroke and/or decrease the phase angle between the displacer and the work producing member to thereby increase the power output from the Stirling engine.

31. The method according to claim 29, wherein the displacer linear electrodynamic machine is designed as a general purpose machine capable of operation either as a linear electric motor or as a linear electric generator wherein the electrodynamic machine is selectively and controllably operated either as a generator load on the displacer and rod assembly to decrease the stroke and/or increase the phase angle between the displacer and the work producing member of the Stirling engine to thereby decrease the power output of the engine or alternatively to operate as a motor for driving the displacer and rod assembly to increase the stroke and/or decrease the phase angle between the displacer and the work producing member to thereby increase the power output from the Stirling engine.

32. The method according to any of claims 28, 29, 30 or 31, further comprising using the displacer linear electrodynamic machine in the drive motor mode to initially start the resonant free-piston Stirling engine.

* * * * *